US006538533B1

(12) United States Patent
Hwang et al.

(10) Patent No.: US 6,538,533 B1
(45) Date of Patent: Mar. 25, 2003

(54) DIELECTRIC RESONATOR FILTER

(75) Inventors: Jae-Ho Hwang, Kyoungi-do (KR); Akihiro Isomura, Sendai (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 09/543,088

(22) Filed: Apr. 4, 2000

(30) Foreign Application Priority Data

Nov. 26, 1999 (JP) ..... 11-335886
Apr. 9, 1999 (JP) ..... 11-103243

(51) Int. Cl.[7] ..... H01P 1/20
(52) U.S. Cl. ..... 333/202; 333/206; 333/207
(58) Field of Search ..... 333/202, 206, 333/207

(56) References Cited

U.S. PATENT DOCUMENTS 3,798,578 A * 3/1974 Konishi et al. ..... 333/202
4,028,652 A * 6/1977 Wakino et al. ..... 333/73
4,881,051 A * 11/1989 Tang et al. ..... 333/135
5,777,534 A * 7/1998 Harrison ..... 333/202
6,255,917 B1 * 7/2001 Scott ..... 29/527.2

FOREIGN PATENT DOCUMENTS

| | | |
|---|---|---|
| EP | 0 867 965 A2 | 9/1998 |
| JP | 60-98702 | 6/1985 |
| JP | 60-248001 | 12/1985 |
| WO | WO 98/25321 | 6/1998 |

* cited by examiner

*Primary Examiner*—Patricia Nguyen
(74) *Attorney, Agent, or Firm*—Frishauf, Holtz, Goodman & Chick, P.C.

(57) ABSTRACT

In order to provide a dielectric resonator filter which can be reduced in dimension, can be reduced in height, and can be surface-mounted, in a dielectric resonator filter including a rectangular-parallelopiped or polygonal-pole-like metal cavity in which at least one dielectric resonator is arranged between one pair of input/output probes, the input/output probes are attached to corner portions of the rectangular-parallelopiped metal cavity.

11 Claims, 12 Drawing Sheets

FIG. 2A
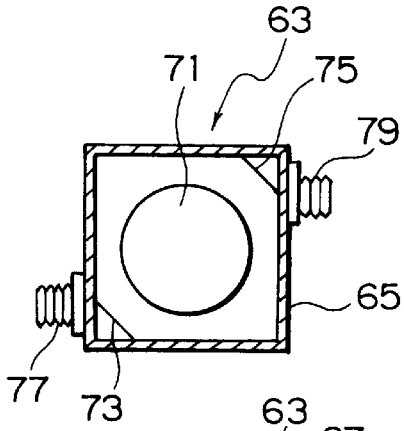
FIG. 2B
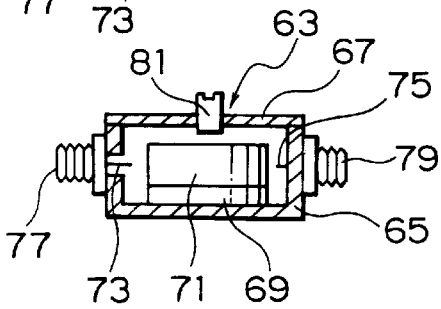
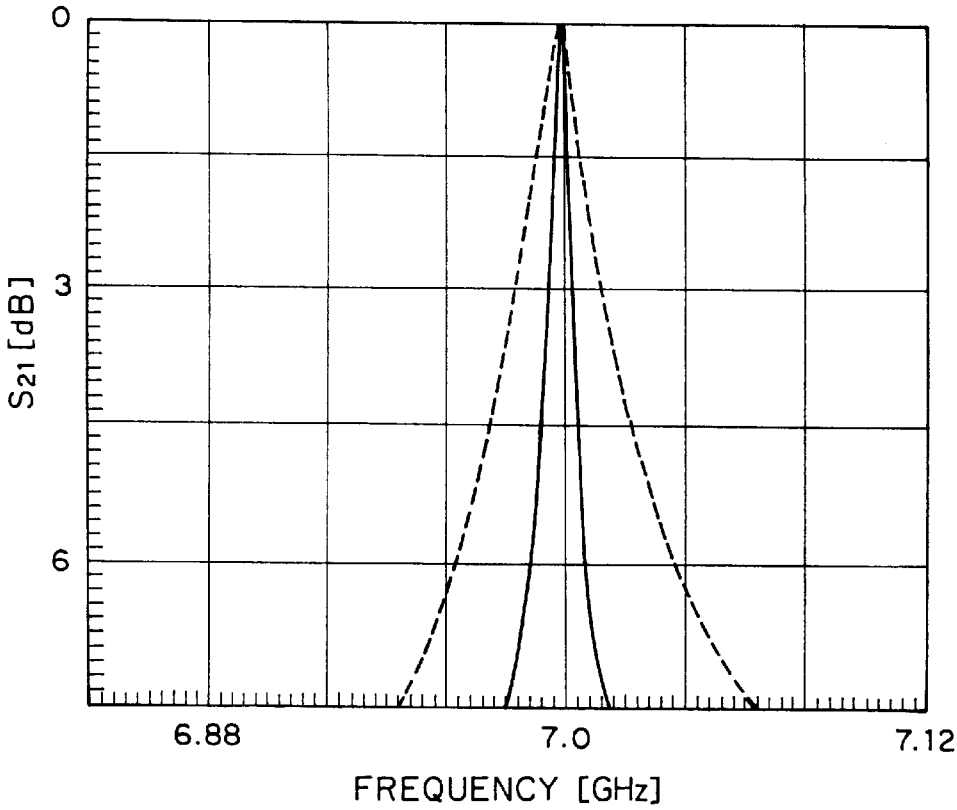
FIG. 3

FIG. 11A
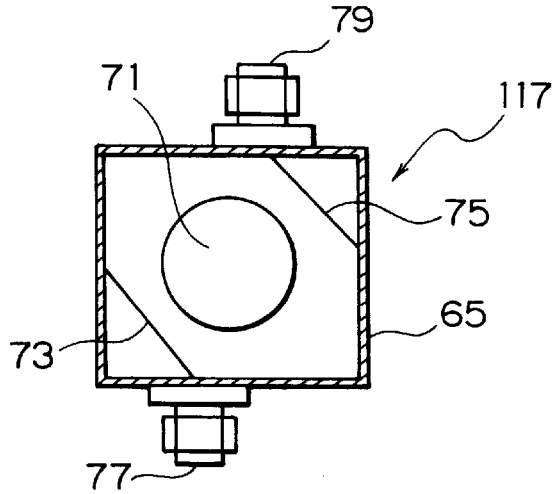
FIG. 11B
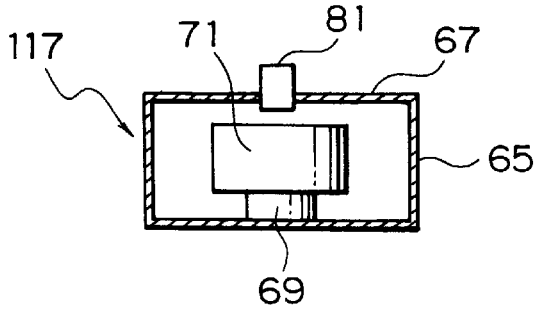
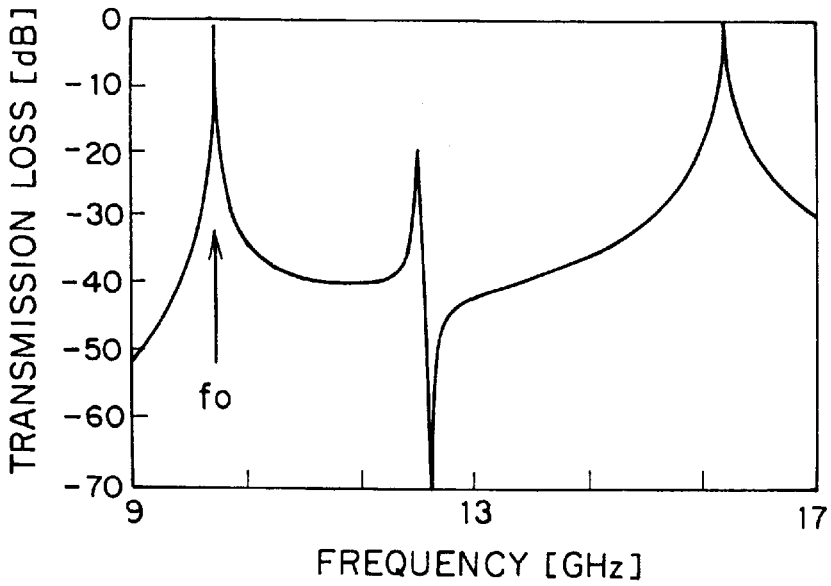
FIG. 12

FIG. 13A
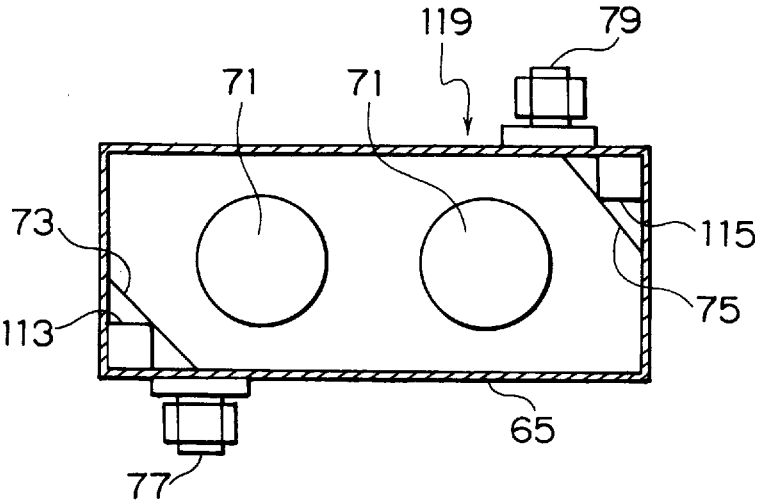
FIG. 13B
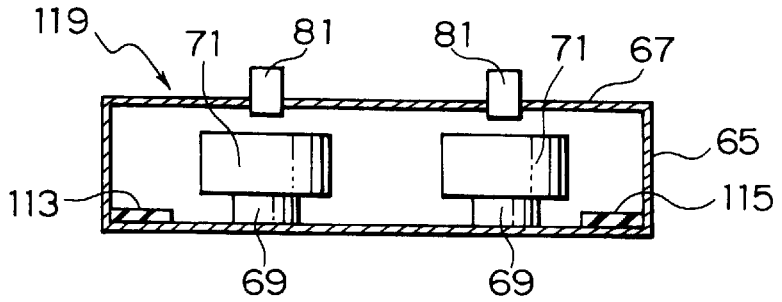
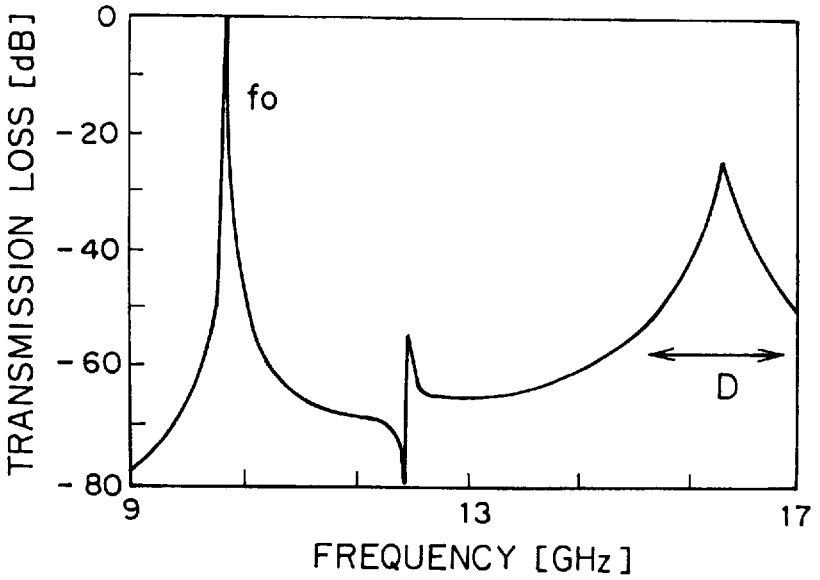
FIG. 14

FIG. 15A
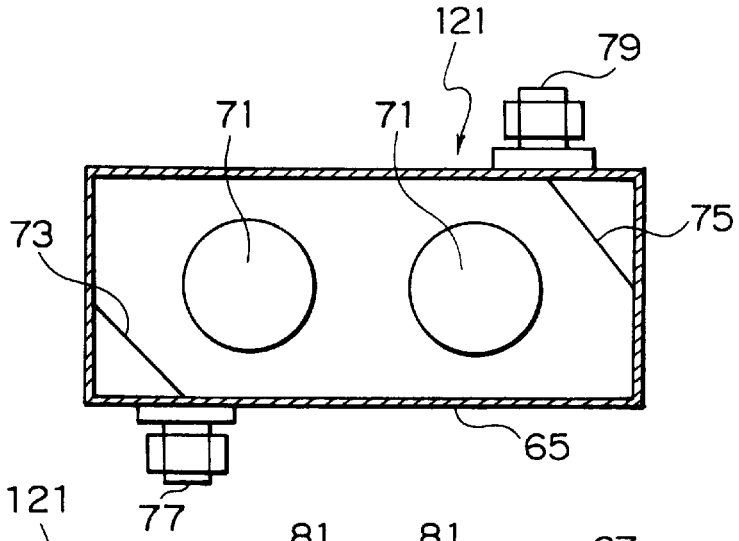
FIG. 15B
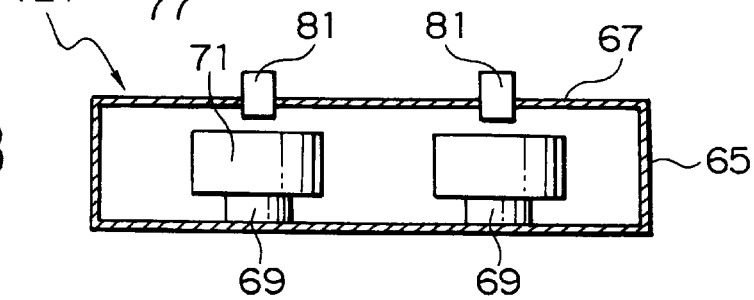
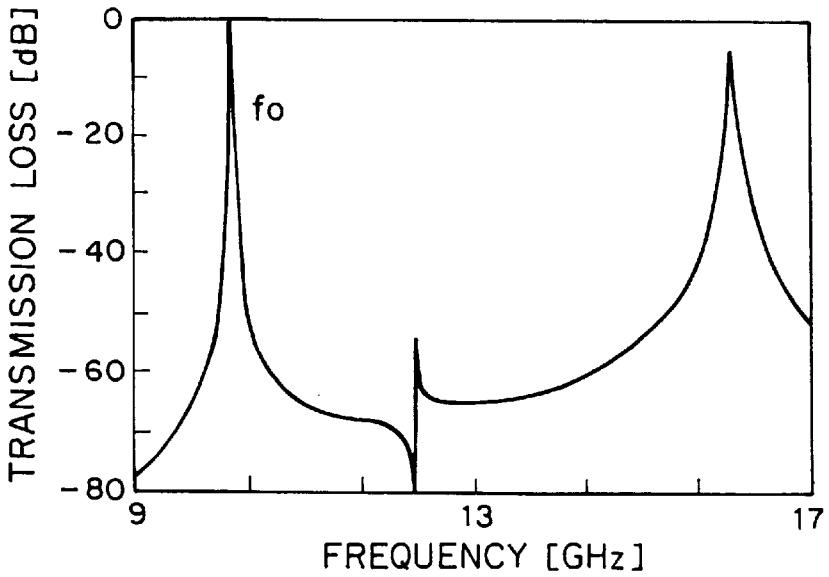
FIG. 16

FIG. 19A
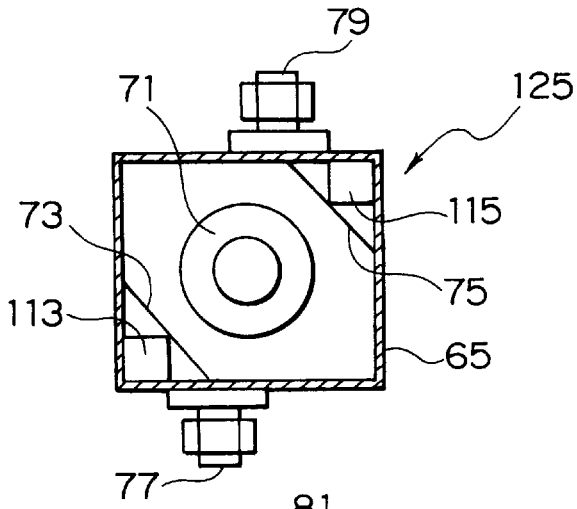
FIG. 19B
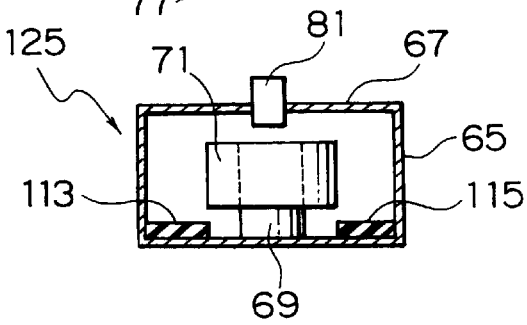
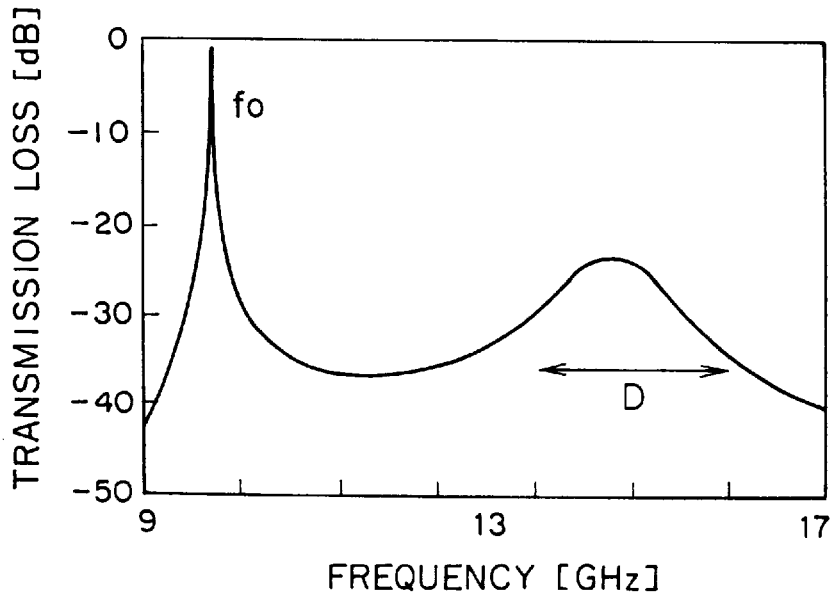
FIG. 20

DIELECTRIC RESONATOR FILTER

BACKGROUND OF THE INVENTION

1. Field of the Invention

The present invention relates to a dielectric resonator filter and, more particularly, to a dielectric resonator filter having low-loss characteristics.

2. Description of the Related Art

A conventional dielectric resonator filter is disclosed in, e.g., Japanese Unexamined Patent Publication (JP-A) No. 60-98702 (to be referred to as prior art 1 hereinafter).

In the dielectric resonator filter disclosed in prior art 1, a box-shaped metal case and a metal cover for covering the upper opening of the metal case constitute a rectangular-parallelopiped metal cavity. A plurality of support tables are arranged in the longitudinal direction of the case on the bottom surface in the metal case. A plurality of columnar dielectric resonators are arranged on the support tables. Input/output terminals having thin and long input/output probes extending in the metal case are arranged outside both the sides of the metal case. When one of the input/output terminals is an input terminal connected to the input probe, another one is an output terminal connected to the input probe. On the other hand, frequency adjustment metal screws are arranged at positions opposing the plurality of dielectric resonators of the metal cover. The intervals between the dielectric resonators and the metal screws are adjusted, so that the frequencies can be adjusted.

Since the input/output probes are electromagnetically coupled to the dielectric resonators, respectively, the input/output probes are arranged at positions each having a level which is almost equal to that of a center position of each dielectric resonator in height as positions at which optimum electromagnetic coupling can be achieved.

However, in a conventional dielectric resonator filter, input/output probes are attached to the central portions of one side of a rectangular metal case inside the metal case. Since the dimensions of the metal case are uniquely determined according to the distances between the input/output probes and the columnar dielectric resonators, the dielectric resonator filter cannot be easily reduced in dimension.

The dielectric resonator filter according to prior art 1 has an unnecessary resonance mode of the dielectric resonator and an unnecessary resonance mode determined by the shape and dimensions of the metal case including resonators. For this reason, a plurality of unnecessary resonance modes (HE, TM, and EH modes or the like) are disadvantageously generated in a band having a frequency which is 1.25 or more times a frequency f0 of a basic resonance mode ($TEO_{01\delta}$ mode).

These unnecessary resonance modes can be suppressed by adding, e.g., low-pass filters or the like. For this reason, the system cannot be easily reduced in dimension.

SUMMARY OF THE INVENTION

It is an object of the present invention to provide a dielectric resonator filter which can be reduced in dimension.

It is another object of the present invention to provide a dielectric resonator filter which can be reduced in height and can be surface-mounted.

According to one aspect of the present invention, there is provides a dielectric resonator filter which includes a metal cavity. The metal cavity has a rectangular parallelopiped and in which at least one dielectric resonator is arranged between one pair of input/output probes. In the dielectric resonator filter, the input/output probes are attached to corner portions of the metal cavity.

According another aspect of the present invention, there is provided a dielectric resonator filter which includes a metal cavity. The metal cavity has a rectangular parallelopiped and in which at least one dielectric resonator is arranged between one pair of input/output probes. In the dielectric resonator filter, at least one electromagnetic wave abs orber is further attached to the in side of the metal cavity.

BRIEF DESCRIPTION OF THE DRAWINGS

FIG. 2A is a plan view of a dielectric resonator filter according to the first embodiment of the present invention;

FIG. 2B is a sectional view of the dielectric resonator filter in FIG. 2A;

FIG. 3 is a graph showing frequency characteristics of the dielectric resonator filter in FIG. 2;

FIG. 11A is a plan view showing, as Comparative Example 1 for the sixth embodiment of the present invention, a dielectric resonator filter in which the metal cover of the upper surface is removed from the dielectric resonator filter;

FIG. 11B is a sectional view of the dielectric resonator filter shown in FIG. 11A;

FIG. 12 is a graph showing the frequency characteristics of the dielectric resonator filter in FIGS. 11A and 11B;

FIG. 13A is a plan view of a dielectric resonator filter according to the seventh embodiment of the present invention in which the metal cover of the upper surface is removed from the dielectric resonator filter, FIG. 13B is a sectional view of the dielectric resonator filter in FIG. 13A;

FIG. 14 is a graph showing the frequency characteristics of the dielectric resonator filter in FIGS. 13A and 13B;

FIG. 15A is a plan view showing, as Comparative Example 2 for the seventh embodiment of the present invention, a dielectric resonator filter in which the metal cover of the upper surface is removed from the dielectric resonator filter;

FIG. 15B is a sectional view of the dielectric resonator filter in FIG. 15A;

FIG. 16 is a graph showing the frequency characteristics of the dielectric resonator filter in FIGS. 15A and 15B;

FIG. 19A is a plan view of a dielectric resonator filter according to the ninth embodiment of the present invention in which the metal cover of the upper surface is removed from the dielectric resonator filter;

FIG. 19B is a sectional view of the dielectric resonator filter in FIG. 19A;

FIG. 20 is a graph showing the frequency characteristics of the dielectric resonator filter in FIGS. 19A and 19B;

DESCRIPTION OF THE PREFERRED EMBODIMENTS

Before the embodiments of the present invention are described, to make it possible to easily understand the present invention, a dielectric resonator filter according to a prior art will be described below with reference to FIGS. 1A and 1B.

Figure 1A:
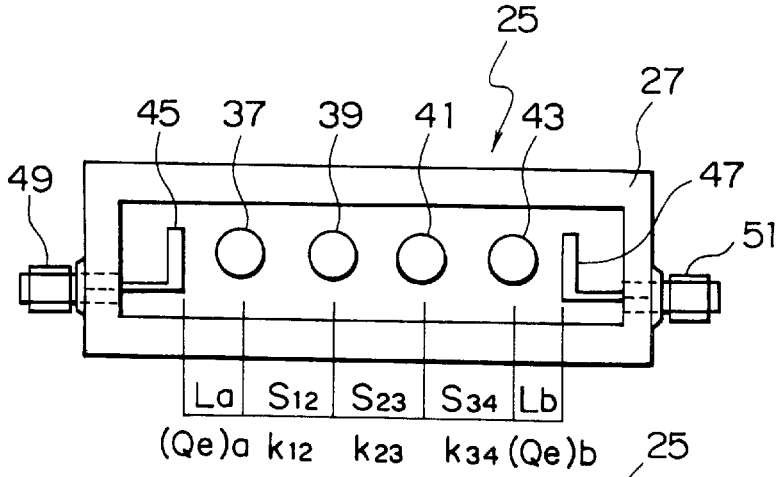
FIG. 1A PRIOR ART
FIG. 1A is a plan view showing an example of the structure of a conventional dielectric resonator filter.
Figure 1B:
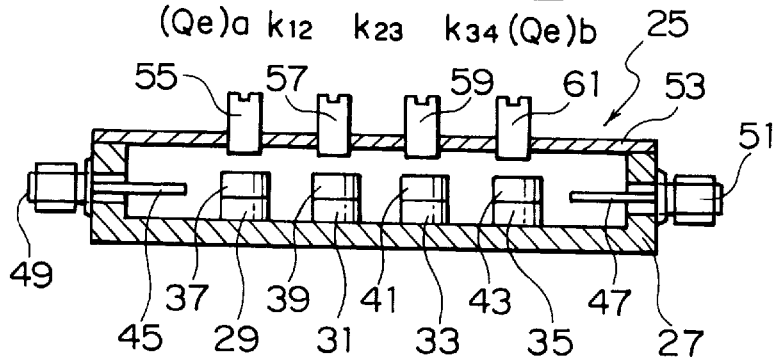
FIG. 1B PRIOR ART
FIG. 1B is a sectional view of the dielectric resonator filter in FIG. 1A.

Referring to FIGS. 1A and 1B, in a dielectric resonator filter 25, a metal cavity is formed in a metal case 27 and a metal cover 53. Support tables 29, 31, 33, and 35 are longitudinally aligned and are arranged on the bottom surface of the metal case 27. Columnar dielectric resonators 37, 39, 41, and 43 are arranged on the support tables 29, 31, 33, and 35, respectively. As the material of the support tables 29, 31, 33, and 35, a material is generally used which degrades the Q-values of the dielectric resonators 37, 39, 41, and 43 as small as possible.

Input/output terminals 49 and 51 have input/output probes 45 and 47 arranged in the case 27 and are arranged on both the sides of the metal case 27 such that the input/output terminals 49 and 51 extend to the outside. The metal cover 53 is arranged to cover the opening of the upper end of the metal case 27. On the metal cover 53, frequency adjustment metal screws 55, 57, 59, and 61 are arranged at the positions opposing the dielectric resonators 37, 39, 41, and 43, respectively. The frequency adjustment metal screws 55, 57, 59, and 61 are rotated to move forwards or backwards, so that the intervals between the dielectric resonators 37, 39, 41, and 43 and the frequency adjustment metal screws 55, 57, 59, and 61 are adjusted. In this manner, resonated frequencies can be adjusted.

The input/output probes 45 and 47 are connected to the internal side of the metal case 27 because the input/output probes 45 and 47 are electromagnetically coupled to the dielectric resonators 37 and 43 on both the sides. The input/output probes 45 and 47 are arranged at the positions having a level which is almost equal to that of a center position of each dielectric resonator in height as positions at which optimum electromagnetic coupling can be achieved.

Reference symbols La, $S_{12}$, $S_{23}$, $S_{34}$, and Lb shown in FIGS. 1A and 1B denote physical lengths, and reference symbols $(Qe)_a$, $k_{12}$, $k_{23}$, $k_{34}$, and $(Qe)_b$ shown in FIGS. 1A and 1B denote electromagnetic coupling quantities.

In general, electromagnetic coupling quantities $(Qe)_a$ and $(Qe)_b$ of the input and output and a dielectric coupling quantity $k_{j,j+1}$ of the jth and (j+1)th dielectric resonators are expressed as in the following equations.

$$(Qe)_a = g_0 \times g_1 \times \omega_1'/w$$

$$(Qe)_b = \omega_1' \times g_n \times g_{n+1}/w$$

$$k_{j,j+1} = \frac{w}{\omega_1' \sqrt{g_j \times g_{j+1}}}$$

$$w = \frac{\omega_2 - \omega_1}{\omega_0}$$

In the equations, reference symbols $\omega_1'$, $g_0$, $g_1$, . . . $g_{n+1}$ denote values which are theoretically calculated in a filter using n pieces of resonator, and reference symbols $\omega_0$, $\omega_1$, and $\omega_2$ denote quantities which are obtained in passing characteristics. Reference symbol w is a quantity which is determined according to the quantities $\omega_0$, $\omega_1$, and $\omega_2$ and a quantity corresponding to a bandwidth.

As described above, the values $\omega_1'$, $g_0$, $g_1$, . . . , $g_{n+1}$ are values determined on the basis of the filter theory. For this reason, when a bandwidth $(\omega_2-\omega_1)$ and a center frequency $\omega_0$ are determined, $(Qe)_a$, $(Qe)_b$, and $k_{j,j+1}$ are uniquely determined.

In the actual dielectric resonator filter 25 as shown in FIGS. 1A and 1B, the dielectric resonators 37, 39, 41, and 43 are arranged in the metal cavity constituted by the metal case 27 and the cover 53, and coupling between the dielectric resonators is determined by electromagnetic coupling using a resonance mode $TE_{01\delta}$ of the dielectric.

Therefore, the dielectric coupling quantity $k_{j,j+1}$ of the jth and (j+1)th dielectric resonators is deterrhined by an interval $S_{j,j+1}$ between the dielectric resonators, and the electromagnetic coupling quantities $(Qe)_a$ and $(Qe)_b$ of the input and output are determined by the intervals La and Lb between the input/output probes and the input/output dielectric resonators, respectively.

With respect to the four-stage filter example shown in FIGS. 1A and 1B, the coupling coefficients $k_{12}$, $k_{23}$, and $k_{34}$ are uniquely determined according to the intervals $S_{12}$, $S_{23}$, and $S_{34}$, the electromagnetic coupling coefficients $(Qe)_a$ and $(Qe)_b$ are determined according to the distances La and Lb. In this manner, the dielectric resonator filter is designed and manufactured.

As the attaching positions of the antenna probes of the conventional dielectric resonator filter 25, as shown in FIGS. 1A and 1B, the input/output probes 77 and 78 are attached to the central portions of one side of the rectangular metal case 65 on the internal side of the metal case 65. The dimensions of the metal case 65 are uniquely determined according to the distances between the input/output probes 77 and 78 and the columnar dielectric resonators 37 and 43. For this reason, the dielectric resonator filter 25 cannot be easily reduced in dimension.

More specifically, the conventional dielectric resonator filter 25 has unnecessary resonant modes of the dielectric resonators 37, 39, 41, and 43 shown in FIGS. 1A and 1B and unnecessary resonant modes are determined according to the shape and dimensions of the metal case 27 including the resonators. For this reason, a plurality of unnecessary resonance modes (HE, TM, and EH modes or the like) are generated in a band having a frequency which is approximately 1.25 or more times of the basic resonant frequency ($TE_{01\delta}$ mode).

These unnecessary resonant modes can be suppressed by, e.g., a low-pass filter or the like. For this reason, the system cannot be easily reduced in dimension.

Embodiments of the present invention will be described below with reference to the accompanying drawings.

As a communication apparatus used in a microwave region, a communication apparatus in which an original clock oscillation signal is generated by using a dielectric filter using a dielectric ceramic resonator is used. Such a dielectric filter is also mounted on a digital communication apparatus used in a communication network having a transmission rate of about 1 Gbit/sec or more.

Therefore, in the embodiments, the dielectric resonator will be described below.

A communication apparatus in which an original clock oscillation signal is generated by using a dielectric filter using a dielectric ceramic resonator is used. Such a dielectric filter is also mounted on a digital communication apparatus used in a communication network having a transmission rate of about 1 Gbit/sec or more.

The embodiments of the present invention will be described below with reference to the accompanying drawings. In the explanations of the dielectric resonator filters according to the embodiments of the present invention, the same reference numerals as in the dielectric resonator filters shown in the respective drawings denote the same parts in the dielectric resonator filters.

(First Embodiment).

Referring to FIGS. 2A and 2B, in a dielectric resonator filter 63 according to the first embodiment of the present invention, in a metal cavity constituted by a metal case 65 and a metal cover 67, one dielectric resonator 71 arranged on the metal case 65 through a support table 69 and input/output probes 73 and 75 are arranged.

The input/output probes 73 and 75 are coupled to one dielectric resonator 71, and are connected to input/output connectors 77 and 79 which are arranged near corner portions of the metal case 65 to extend outward.

More specifically, the internal dimensions of the metal case 65 are about 20×20×13 mm. The input probe 73 consists of a conductive wire, such as a copper wire, being 0.5 mm in diameter. One end of the input probe 73 is connected to the input connector 77, and the other end is short-circuited to the other surface, on which the input/output connector 77 or 79 is not formed, of the two surfaces of the metal case 65. The conductive wire serving as the input probe 73 is like a straight line, and the distance between the dielectric resonator 71 and the input probe 73 is about 3 mm. The output probe 75 is also manufactured by the same method as that used when the input probe 73 is manufactured.

According to the first embodiment of the present invention, dielectric resonator characteristics were measured by electromagnetic coupling using a resonance mode $TE_{01\delta}$. As a result, when the distances between a dielectric resonator 17 and the input probes 73 and 75 were about 3 mm each, a center frequency was about 7 GHz, and a loaded Q, which will be referred to as $Q_L$, was about 1000. Thereafter, the center frequency can be adjusted to a predetermined frequency by a frequency adjustment metal screw 81 attached to the metal cover 67. In addition, the distances between the dielectric resonator 71 and the input/output probes 73 and 75 were about 1 mm each, the center frequency was about 7 GHz, and a load Q ($Q_L$) was about 280.

FIG. 3 shows the measurement results of frequency characteristics of the filter. In FIG. 3, a solid line indicates the load $Q_L$ obtained when the distances between the dielectric resonator 71 and the input/output probes 73 and 75 are about 3 mm each showing the $Q_L \cong 100$, a broken line indicates frequency characteristics obtained when the distances between the dielectric resonator 71 and the input/output probes 73 and 75 are about 1.5 mm each.

The relationship between $Q_L$ and an input/output electromagnetic coupling quantity Qe is $2/Qe=1/Q_L-1/Q_0$ (where $Q_0$ is the unloaded Q of a resonator).

The dimensions of the dielectric resonator 71 are about ϕ 15×6 mm. The dielectric resonator 71 is arranged by a support table 69 such that the central position of the dielectric resonator 71 in height is located at the positions of the input/output probes 73 and 75. Spare spaces are formed at only the corner portions of the metal case 65 so that the dielectric filter 65 is assembled as small as possible. When the input/output probes 73 and 75 are attached to the corner portions, good workability can be achieved, and the input/output probes 72 and 73 can be attached such that the lengths of the probes are kept at high accuracy.

(Second and Third Embodiments)

Figure 4A:
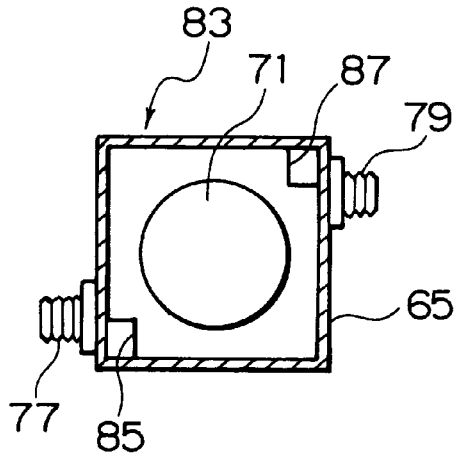
FIG. 4A is a plan view of a dielectric resonator filter according to the second embodiment of the present invention.
Figure 4B:
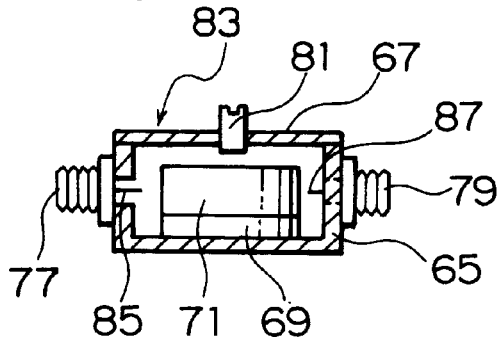
FIG. 4B is a sectional view of the dielectric resonator filter in FIG. 4A.

As shown in FIGS. 4A and 4B and FIGS. 5A and 5B, each of dielectric resonator filter according to the second and third embodiments of the present invention has the same basic configuration as that of the dielectric resonator filter according to the first embodiment shown in FIGS. 2A and 2B. However, a dielectric resonator filter 83 shown in FIGS. 4A and 4B is different from the dielectric resonator filter according to the first embodiment in the following point. That is, conductive wires, such as a copper wire, constituting inpuvoutput probes 85 and 87 are not like straight lines, and the conductive wires are bent at right angles and short-circuited to the other sides.

Figure 5A:
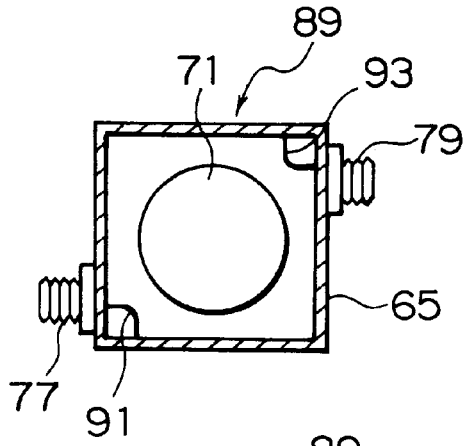
FIG. 5A is a plan view of a dielectric resonator filter according to the third embodiment of the present invention.
Figure 5B:
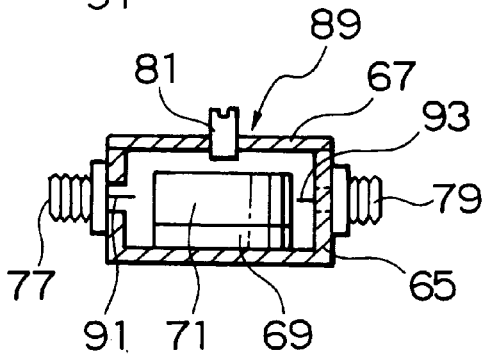
FIG. 5B is a sectional view of the dielectric resonator filter in FIG. 5A.

A dielectric resonator filter 89 shown in FIGS. 5A and 5B is different from the dielectric resonator filter according to the first embodiment in the following point. That is, conductive wires constituting input/output probes 91 and 93 are not like straight lines, and the conductive wires are circularly bent and connected to other sides.

Both the dielectric filters shown in FIGS. 4A and 4B and FIGS. 5A and 5B are selected such that electromagnetic coupling to the dielectric resonators 1 is optimum.

In the first to third embodiments, a portion to which the other end of each of the input/output probes 73, 85, 91, 75, 87, and 93 is connected, i.e., the other surface, on which the input/output connector 77 or 79 is not formed, near a corner portion also includes a peak portion which is the boundary between the two surfaces of the corner portion.

(Fourth Embodiment)

Figure 6A:
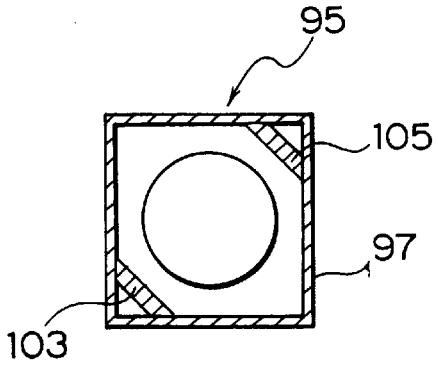
FIG. 6A is a plan view of a dielectric resonator filter according to the fourth embodiment of the present invention.
Figure 6B:
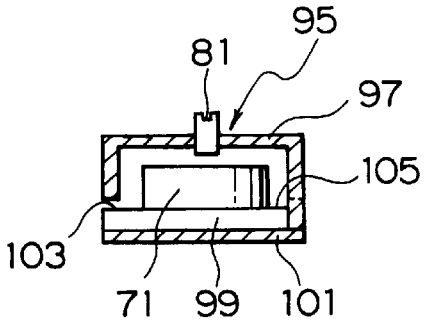
FIG. 6B is a sectional view of the dielectric resonator filter in FIG. 6A.

In FIGS. 6A and 6B, in a dielectric resonator filter 95 according to the fourth embodiment, one dielectric resonator 71 and input/output probes 103 and 105 are arranged in a metal cavity constituted by a metal cover 97 and a metal plate 101 to which a dielectric substrate 99 is attached. The dielectric substrate 99 and the metal plate 101 may be integrally adhered to each other. The input/output probes 103 and 105 are constituted by strip lines.

The internal dimensions of the metal case 95 are about 20×20×13 mm. The input/output probes 103 and 105 are constituted by strip lines each consisting of copper foil having a width of about 1 mm. One end of each input probe is connected to an input or an output terminal, and the other end is short-circuited to the other surface, on which the output or the input terminal is not formed, of the two surfaces near a corner portion. The strip line consisting of copper foil and serving as the input probe 103 is like a flat belt. The distance between a center of the dielectric resonator 71 and the strip lines is approximately 3 mm. The output probe 105 is also manufactured by the same method as that used for the input probe 103. A through hole penetrates the metal cover 97 from the outside of the metal cover 97 into the metal cavity, and terminals such as lead lines can be connected to the input/output probes 103 and 105 by soldering or the like, respectively.

In this manner, when the strip lines are used as the input/output probes 103 and 105, not only a reduction in dimension but also a reduction in height can be achieved, and surface mounting can be achieved.

In the first to fourth embodiments of the present invention described above, the dielectric resonator filter in which one dielectric resonator 71 is used has been described. However, even the dielectric resonator filter has two or more dielectric resonators 71 can be reduced in dimension such that input/output probes are arranged near corner portions of the metal cavity. This case will be described in the fifth embodiment.

(Fifth Embodiment)

Figure 7A:
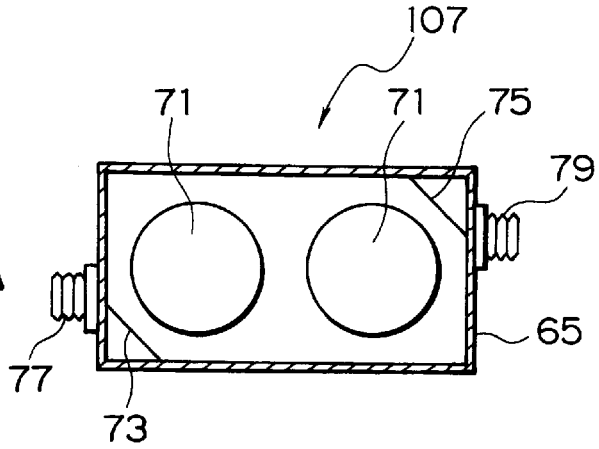
FIG. 7A a plan view of a dielectric resonator filter according to the fifth embodiment of the present invention.
Figure 7B:
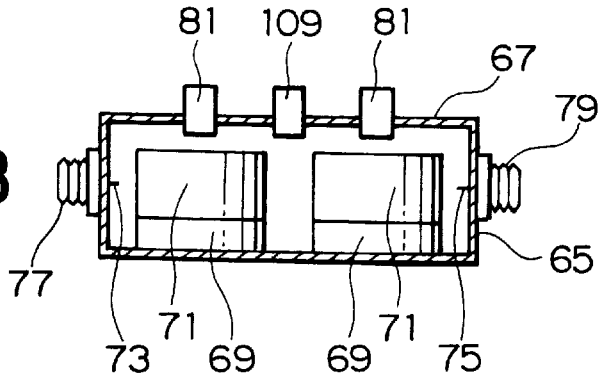
FIG. 7B is a sectional view of the dielectric resonator filter in FIG. 7A.

Referring to FIGS. 7A and 7B, a dielectric resonator filter 107 has the same configuration as that in the first embodiment except that two dielectric resonators 71 are used.

The internal dimensions of a metal case are about 20×40×13 mm. The dimensions of each of the dielectric resonator 71 are about ϕ15×6 mm. The distances between input/output probes 73 and 75 and the dielectric resonators 71 are about 3 mm each, and the distance between the two dielectric resonators 71 is about 5 mm. A coupling adjustment screw 109 is arranged between the dielectric resonators.

Figure 8:
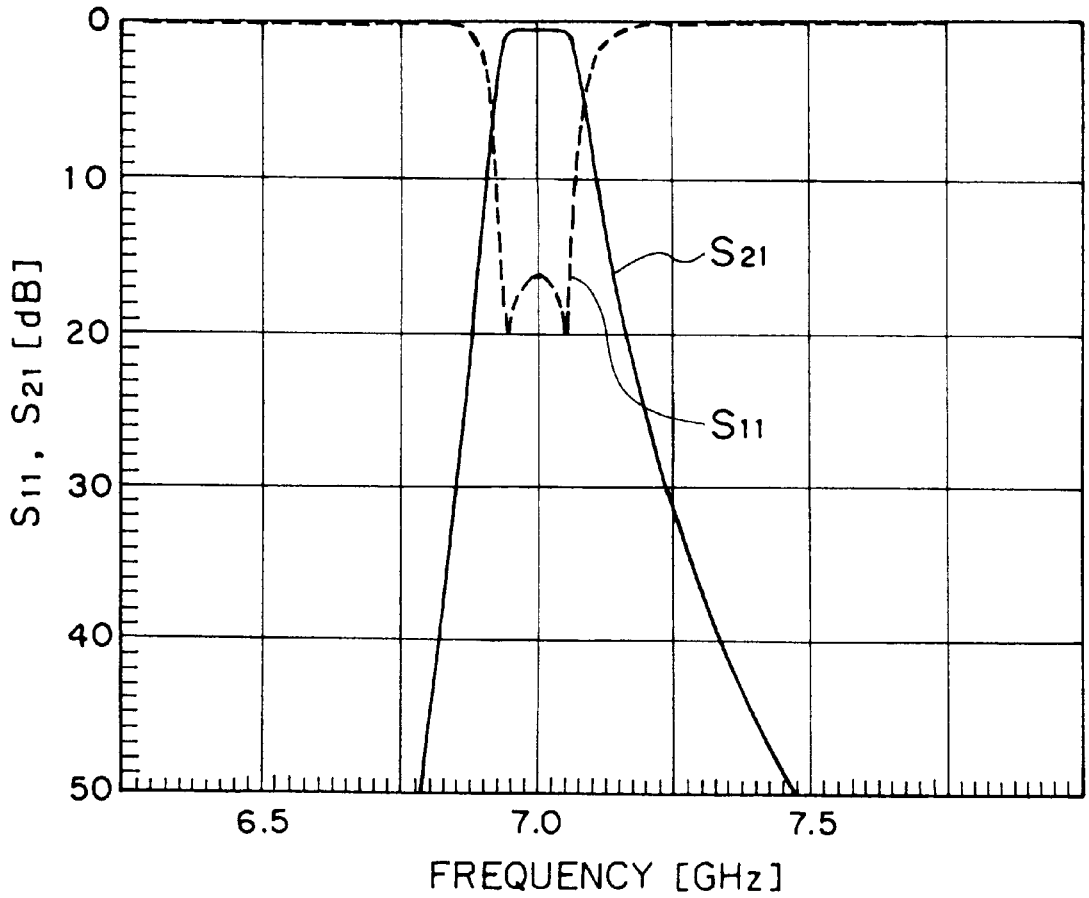
FIG. 8 is a graph showing frequency characteristics of the dielectric resonator filter in FIGS. 7A and 7B.

Referring to FIG. 8, the dielectric resonator filter 107 can obtain characteristics having a center frequency of about 7 GHz.

In the first to fifth embodiments of the present invention described above, the metal cavity has a rectangular-parallelopiped shape. However, a cylindrical metal cavity or a polygonal-pole-like metal cavity other than a rectangular-parallelopiped metal cavity can also be used as a matter of course.

As has been described above, in the dielectric resonator filters according to the first to fifth embodiments of the present invention, input/output probes are attached to corner portions of rectangular cavities. For this reason, the dielectric resonator filters can be reduced in dimension. In addition, when the input/output probes are constituted by strip lines, a dielectric resonator filter which can be reduced in height and which can be surface-mounted can be provided.

(Sixth Embodiment)

Figure 9A:
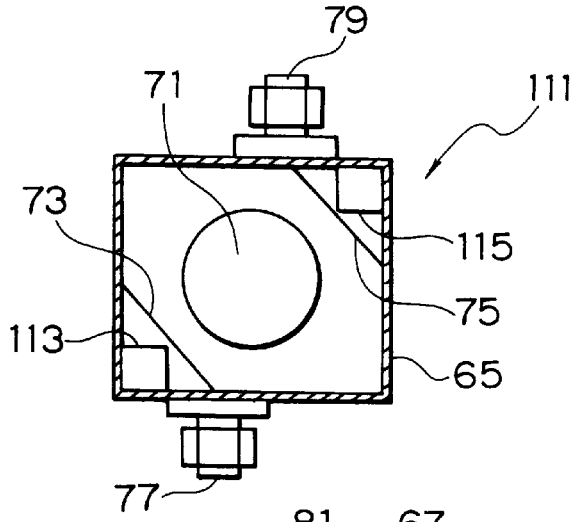
FIG. 9A is a plan view of a dielectric resonator filter according to the sixth embodiment of the present invention in which the metal cover of the upper surface is removed from the dielectric resonator filter.
Figure 9B:
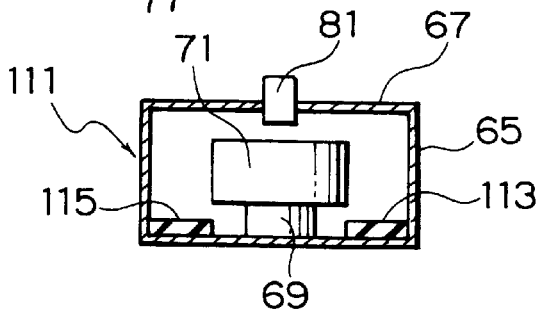
FIG. 9B is a sectional view of the dielectric resonator filter in FIG. 9A.

Referring to FIGS. 9A and 9B, in a dielectric resonator filter 111 according to the sixth embodiment of the present invention, one end of the input probe 73 is connected to a connector 77, and the other end is short-circuited to the other surface of the two surfaces of a metal case 65 near a corner at which the input/output connector 77 or 79 is not arranged. An output probe 75 is also manufactured by the same method as that used when the input probe 73 is manufactured.

The dielectric resonator filter 111 shown in FIGS. 9A and 9B includes two electromagnetic wave absorbers 113 and 115 arranged therein. The absorbers 113 and 115 may be effectively made of a ferromagnetic ferrite compound having a ferromagnetic resonant absorption at a frequency range of 9 to 14 GHz or at a frequency range between 1.3 and 2 times of the center frequency of the filter.

Figure 10:
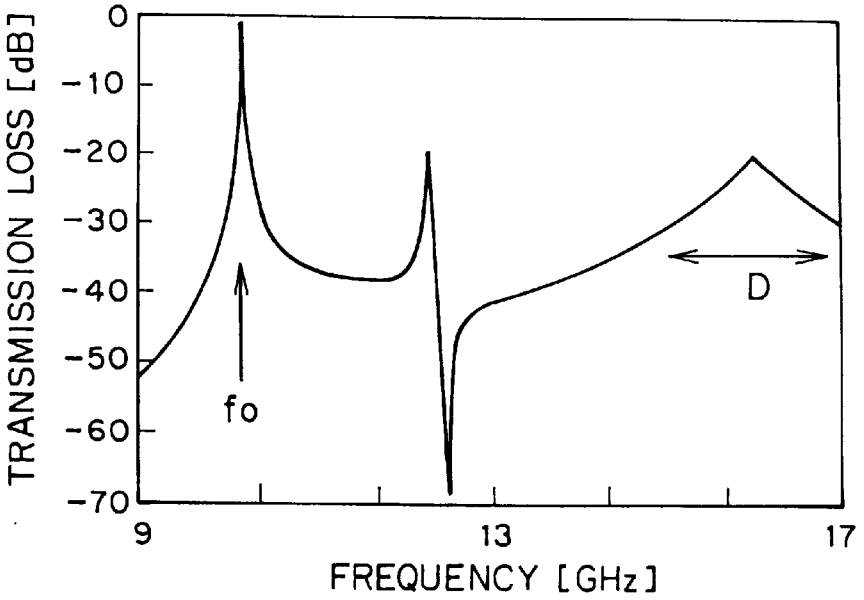
FIG. 10 is a graph showing the frequency characteristics of the dielectric resonator filter shown in FIGS. 9A and 9B.

Referring to FIG. 10, the frequency characteristics of the dielectric resonator filter 111 according to the sixth embodiment of the present invention are shown. The electromagnetic wave absorbers 113 and 115 are adhered to two lower-surface corner portions of the metal case 65, i.e., near the input/output connectors 77 and 79.

Referring to FIGS. 11A and 11B, the configuration of a dielectric resonator filter experimentally manufactured as Comparative Example 1 of the first embodiment of the present invention is shown.

FIG. 12 shows the frequency characteristics of a dielectric resonator filter shown in FIGS. 11A and 11B.

The electromagnetic wave absorbers 113 and 115 used in the dielectric resonator filter 111 in FIG. 9 have absorption characteristics in a band having a bandwidth of about 15 GHz. As is apparent from FIGS. 10 and 12, unnecessary resonance in a band having a bandwidth of 15 to 17 GHz (region D) is suppressed in the frequency characteristics of the dielectric resonator filter according to the sixth embodiment of the present invention shown in FIG. 10 in comparison with the frequency characteristics of the comparative example shown in FIG. 12.

(Seventh Embodiment)

Referring to FIGS. 13A and 13B, in a dielectric resonator filter 119 according to the seventh embodiment of the present invention, in a metal cavity constituted by a metal case 65 and a metal cover 67, two dielectric resonators 71 are arranged on the bottom portion of a metal case 65 through support tables 69. One end of an input (output) probe 73 is connected to an input/output connector 77, and the other end is short-circuited to the other surface of the two surfaces of the metal case 65 near a corner at which the connector 77 or 79 is not arranged. An output (input) probe 75 is also manufactured by the same method as that used when the input probe 73 is manufactured.

The dielectric resonator filter 119 shown in FIGS. 13A and 13B includes two electromagnetic wave absorbers 113 and 115 arranged therein.

Referring to FIG. 14, the frequency characteristics of the dielectric resonator filter shown in FIGS. 13A and 13B are shown. The electromagnetic wave absorbers 113 and 115 are adhered to two lower-surface corner portions of the metal case 65.

Referring to FIGS. 15A and 15B, a dielectric resonator filter experimentally manufactured as Comparative Example 2 of the seventh embodiment of the present invention is the same as the dielectric resonator filter according to the seventh embodiment except that electromagnetic wave absorbers are not arranged. The frequency characteristics of the dielectric resonator filter according to Comparative Example 2 are shown in FIG. 16.

The electromagnetic wave absorbers 113 and 115 used in the dielectric resonator filter shown in FIGS. 13A and 13B have absorption characteristics in a band having a bandwidth of about 15 GHz.

As is apparent from the comparison in FIGS. 14 and 16, unnecessary resonance in a band of 15 to 17 GHz (region D) is suppressed in the frequency characteristics of the dielectric resonator filter according to the seventh embodiment of the present invention in comparison with the frequency characteristics of Comparative Example 2.

(Eighth Embodiment)

Figure 17A:
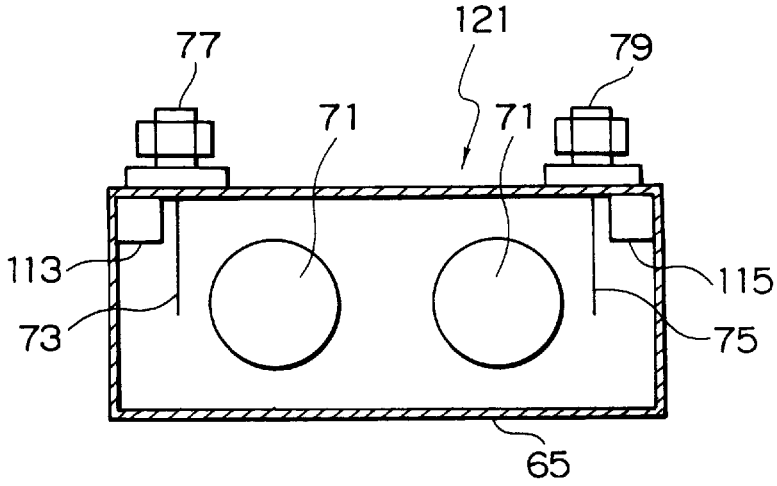
FIG. 17A is a plan view of a dielectric resonator filter according to the eighth embodiment of the present invention in which the metal cover of the upper surface is removed from the dielectric resonator filter.
Figure 17B:
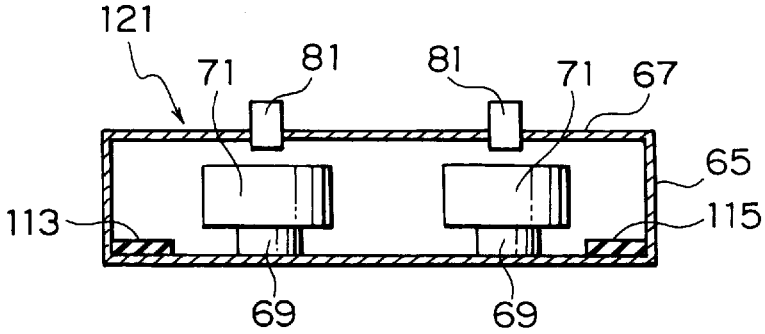
FIG. 17B is a sectional view of the dielectric resonator filter in FIG. 17A.

Referring to FIGS. 17A and 17B, in a dielectric resonator filter 121 according to the eighth embodiment of the present invention, in a metal cavity constituted by a metal case 65 and a metal cover 67, two dielectric resonators 71 arranged on the metal case 65 through support tables 69 and input/output connectors 77 and 79 having input/output probes 73 and 75 are arranged.

The electromagnetic wave absorbers 113 and 115 are adhered to two lower-surface corner portions of the metal case 65.

The frequency characteristics of the dielectric resonator filter when the electromagnetic wave absorbers 113 and 115 are adhered to the two lower-surface corner portions (near the input/output connectors 77 and 79) of the metal case 65 in the dielectric resonator filter 121 are almost the same as those shown in FIG. 14.

Figure 18A:
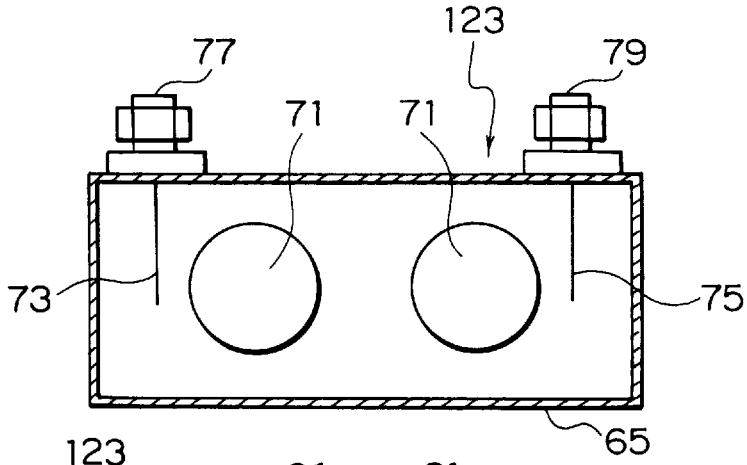
FIG. 18A is a plan view showing, as Comparative Example 3 for the eighth embodiment of the present invention, a dielectric resonator filter in which the metal cover of the upper surface is removed from the dielectric resonator filter.
Figure 18B:
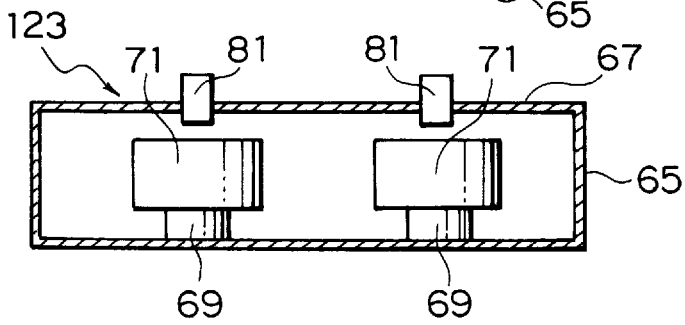
FIG. 18B is a sectional view of the dielectric resonator filter in FIG. 18A.

Referring to FIGS. 18A and 18B, a dielectric resonator filter 123 experimentally manufactured as Comparative Example 3 of the eighth embodiment of the present invention is the same as the dielectric resonator filter according to the third embodiment of the present invention except that electromagnetic wave absorbers are not arranged. When the frequency characteristics of the dielectric resonator filter according to Comparative Example 2 were examined, almost the same characteristics as those shown in FIG. 16 were exhibited.

(Ninth Embodiment)

Referring to FIGS. 9A and 9B, a dielectric resonator filter 125 according to the ninth embodiment of the present invention is manufactured by using a ring-like dielectric resonator. In the dielectric resonator filter 125, two electromagnetic wave absorbers 113 and 115 are arranged in a metal case 65.

As shown in FIG. 20, the frequency characteristics of the dielectric resonator filter according to the ninth embodiment are shown. The electromagnetic wave absorbers 113 and 115 are adhered to two lower-surface corner portions (near input/output connectors 77 and 79) of the metal case 65.

Figure 21A:
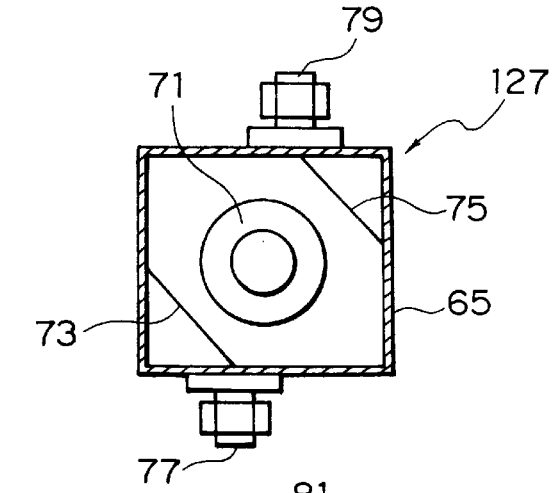
FIG. 21A is a plan view showing, as Comparative Example 4 for the ninth embodiment of the present invention, a dielectric resonator filter in which the metal cover of the upper surface is removed from the dielectric resonator filter.
Figure 21B:
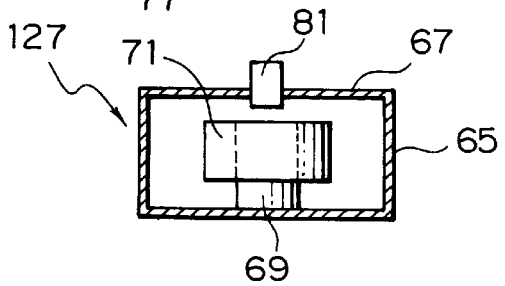
FIG. 21B is a sectional view of the dielectric resonator filter in FIG. 21A.

Referring to FIGS. 21A and 21B, a dielectric resonator filter 127 experimentally manufactured as Comparative Example 4 of the ninth embodiment of the present invention has the same configuration as that of the dielectric resonator filter according to the ninth embodiment except that electromagnetic wave absorbers are not arranged.

Figure 22:
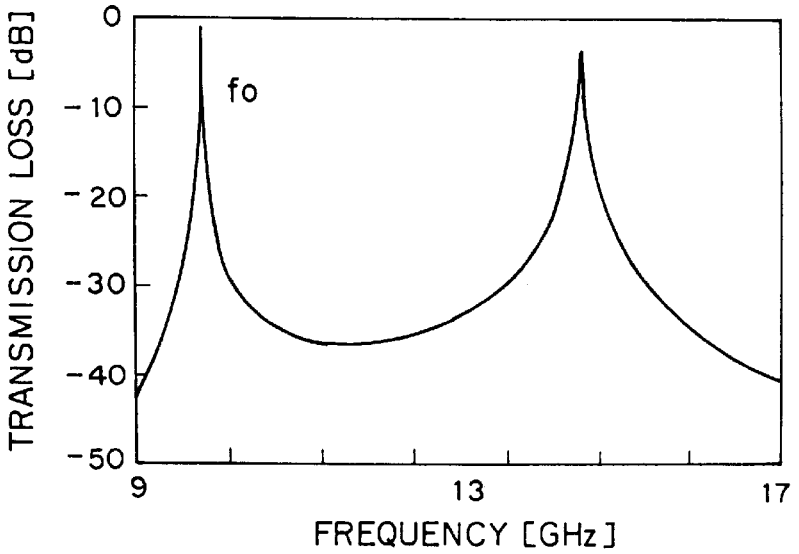
FIG. 22 is a graph showing the frequency characteristics of Comparative Example 4.

When the frequency characteristics of the dielectric resonator filter according to Comparative Example 4 were examined, the characteristics shown in FIG. 22 were exhibited.

The electromagnetic wave absorbers 113 and 115 used in the dielectric resonator filter according to the ninth embodiment of the present invention shown in FIGS. 19A and 19B have absorption characteristics in a band having a bandwidth of about 15 GHz.

As is apparent from the comparison in FIGS. 20 and 22, unnecessary resonance in a band of about 15 GHz (region D) is suppressed in the frequency characteristics of the dielectric resonator filter according to the ninth embodiment of the present invention in comparison with the frequency characteristics of Comparative Example 2.

As has been described above, in the dielectric resonator filters according to the sixth to ninth embodiments of the present invention, electromagnetic wave absorbers are arranged at corner portions of rectangular cavities, so that unnecessary modes can be suppressed.

What is claimed is:

1. A dielectric resonator filter comprising:

a metal cavity;

an input probe and an output probe attached to respective diagonally opposite corner portions of the metal cavity; and at least one dielectric resonator arranged between the input and output probes.

2. A dielectric resonator filter according to claim 1, wherein each of the corner portions of the metal cavity comprises two surfaces, and the input and output probes are attached to the corner portions such that the two surfaces of each of the corner portions are short-circuited.

3. A dielectric resonator filter according to claim 2, wherein the input and output probes comprise linear conductive lines.

4. A dielectric resonator filter according to claim 2, wherein the input and output probes comprise strip lines.

5. A dielectric resonator filter according to claim 4, wherein the metal cavity is defined by a metal housing, and a through hole for connecting to the strip lines is formed in the metal housing.

6. A dielectric resonator filter according to claim 1, wherein the metal cavity has a rectangular parallelopiped shape.

7. A dielectric resonator filter according to claim 1, further comprising a support table arranged on a bottom plate of the metal cavity, and wherein the dielectric resonator is fixed on the support table.

8. A dielectric resonator filter according to claim 1, further comprising a frequency adjustment screw arranged at a position opposing a free end face of the dielectric resonator.

9. A dielectric resonator filter according to claim 8, further comprising input and output connectors respectively connected to the input and output probes, and wherein the input and output connectors are formed at positions point-symmetrical about a center axis of the dielectric resonator filter on opposing side surfaces.

10. A dielectric resonator filter according to claim 1, wherein at least two substantially identical dielectric resonators are arranged between the input and output probes, and wherein the dielectric resonator filter further comprises a frequency adjustment screw arranged at a position opposing a free end face of each of the dielectric resonators, and a coupling adjustment screw arranged between the frequency adjustment screws.

11. A dielectric resonator filter including a metal cavity which has a rectangular parallelopiped shape, and in which at least one dielectric resonator is arranged between one pair of input/output probes, wherein the input/output probes are attached to corner portions of the metal cavity such that respective two surfaces constituting each of the corner portions are short-circuited, and wherein the input/output probes comprise linear conductive lines.

* * * * *